US006696634B1

(12) United States Patent
Zuloff

(10) Patent No.: US 6,696,634 B1
(45) Date of Patent: Feb. 24, 2004

(54) LIQUID ACTUATED ELECTRONIC MUSICAL DEVICE

(75) Inventor: Steven Zuloff, Chatsworth, CA (US)

(73) Assignee: CYI, Inc., Chatsworth, CA (US)

( * ) Notice: Subject to any disclaimer, the term of this patent is extended or adjusted under 35 U.S.C. 154(b) by 0 days.

(21) Appl. No.: 10/341,902

(22) Filed: Jan. 14, 2003

(51) Int. Cl.[7] ..... Q10H 1/32; G10H 3/00
(52) U.S. Cl. ..... 84/744
(58) Field of Search ..... 84/622, 639, 743, 84/744

(56) References Cited

U.S. PATENT DOCUMENTS 4,627,326 A * 12/1986 McFarland ..... 84/94.2
4,949,385 A * 8/1990 Murphy ..... 381/118

* cited by examiner

*Primary Examiner*—Jeffrey Donels
(74) *Attorney, Agent, or Firm*—Howard C. Miskin, Esq.; Gloria Tsui-Yip, Esq.

(57) ABSTRACT

An electronic musical device having a keyboard actuated by random liquid drops. The device includes a base, a synthesizer, a keyboard having a plurality of keys pivotably attached to the base to actuate the synthesizer and a tube assembly extending above the keys that produces drops of liquid that fall periodically onto the keys to produce a melody.

14 Claims, 4 Drawing Sheets

LIQUID ACTUATED ELECTRONIC MUSICAL DEVICE

FIELD OF THE INVENTION

The invention relates to an electronic musical device. In particular, an electronic musical device having a keyboard actuated by random liquid drops.

BACKGROUND OF THE INVENTION

Electronic musical instruments that provide synthesized music of various musical instruments are common. For example, electronic guitar, piano, etc. One common type of electronic musical instruments resembles a piano, with a traditional piano keyboard, but provides different choices of synthesized sound of various musical instruments. After selecting a particular musical instrument for the electronic musical instrument, a user presses the keys on the keyboard to obtain different tones, similar to a traditional piano.

These prior art electronic musical instruments require the user's input to produce a musical composition. The player must be knowledgeable of the music to be played and how to input the music source tot the corresponding keys to produce the sound desired.

SUMMARY OF THE INVENTION

The present invention provides an electronic musical device having a keyboard actuated by random liquid drops to create unlimited variations of musical scores that is original each time it is used.

The electronic musical device of the present invention comprises a base having a reservoir and a plurality of keys pivotably attached to the base over the reservoir. Each key has an arm connected with an electronic circuitry in the base for actuating a particular musical tone when the key is pivoted. A horizontally positioned drip tube is positioned to overlie the keys and has a plurality of small holes, with each small hole positioned over a corresponding key. Liquid is pumped to and through the drip tube with liquid drops formed at each small hole. Once a liquid drop achieves a certain size for separation, the drop falls onto a corresponding key causing it to play a musical tone.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
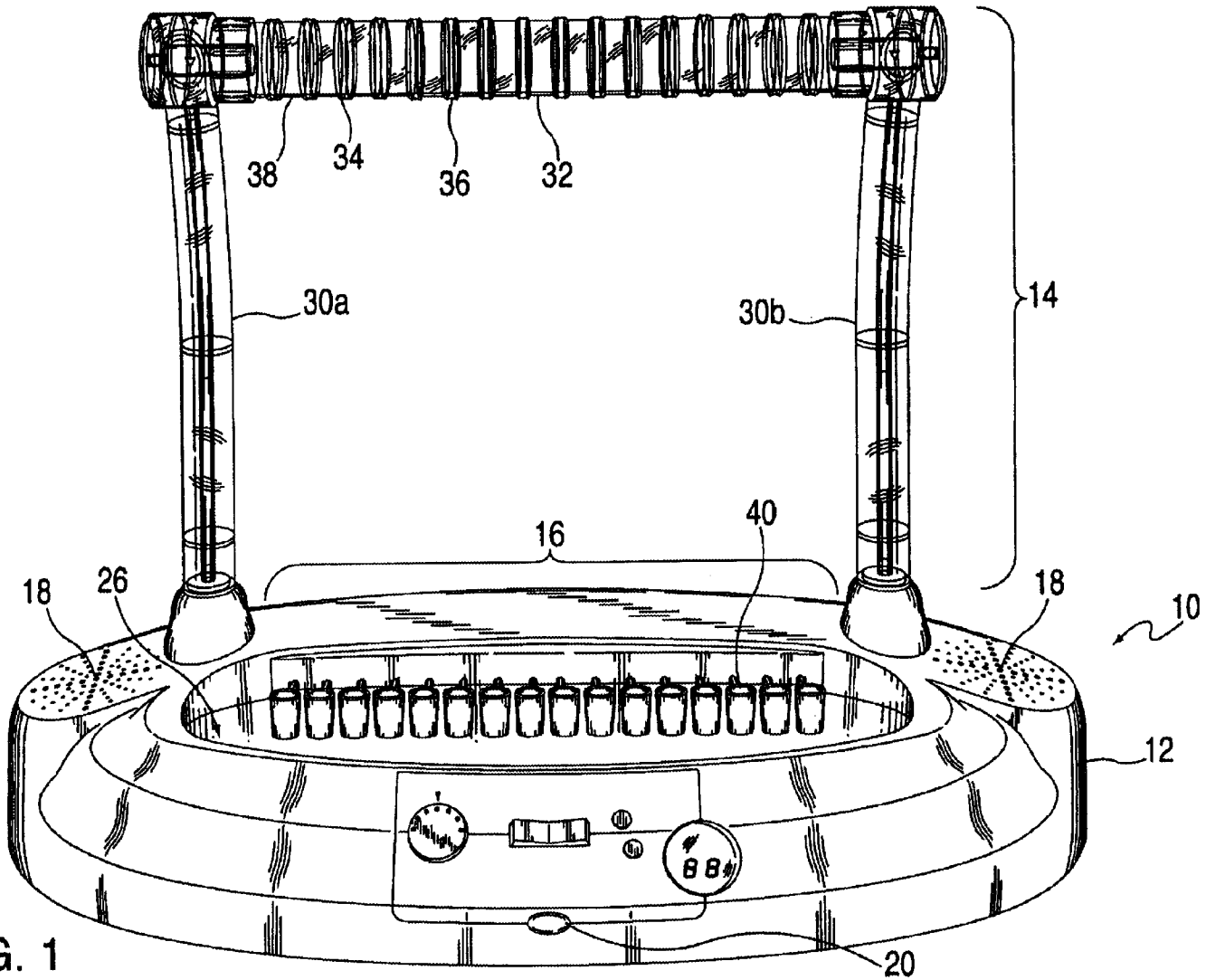
FIG. 1 is perspective view of liquid actuated electronic musical device of the present invention.

With reference to the drawings, wherein the same reference number indicates the same element throughout, there is shown in FIG. 1 a liquid actuated electronic musical device 10 of the present invention. The electronic musical device 10 preferably utilizes de-mineralized water as the liquid medium to actuate the device 10 to prolong the life of the device 10. However, any other liquid can be used. The electronic musical device 10 comprises a base 12, a tube assembly 14 and a keyboard 16.

Figure 2:
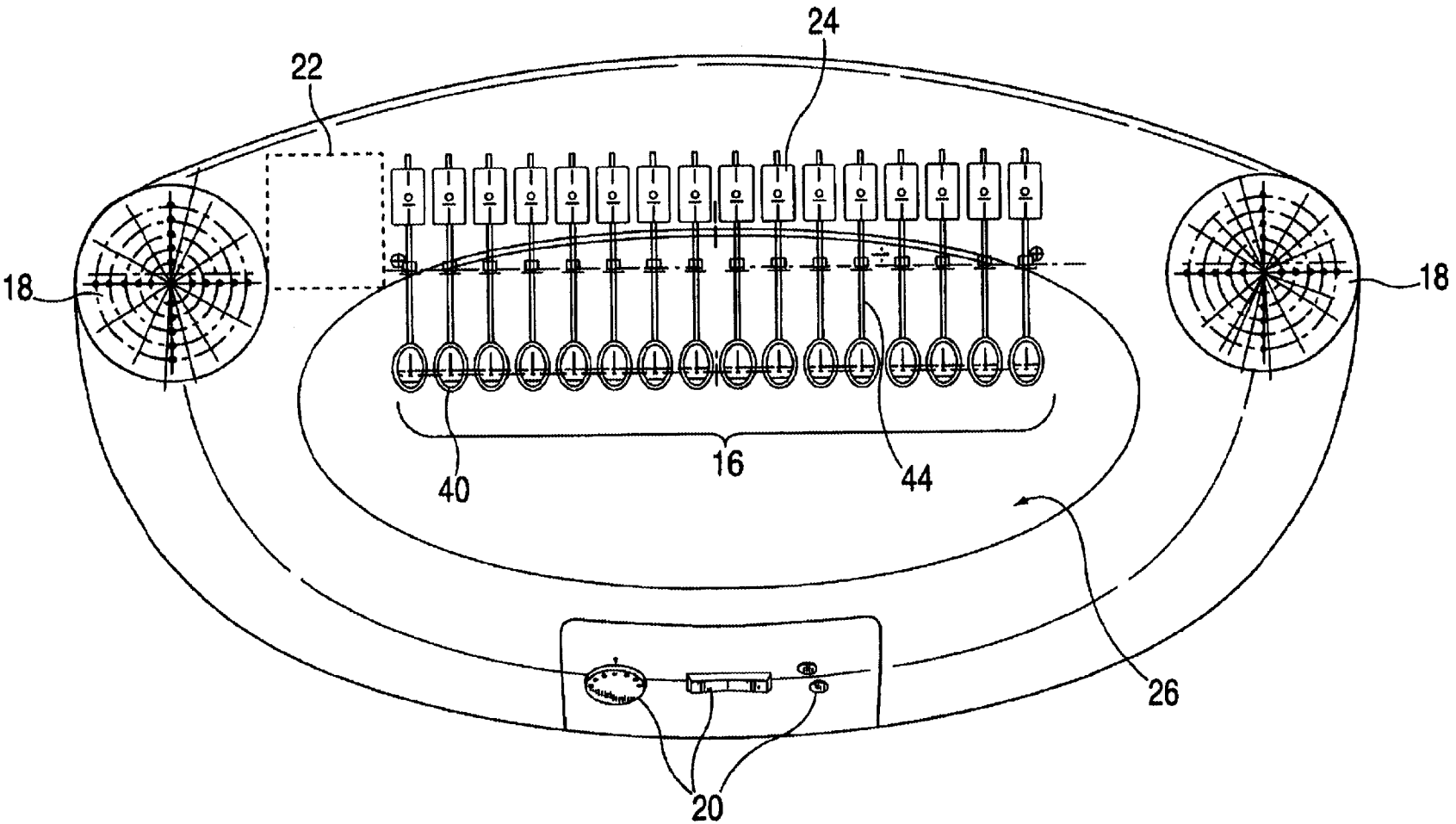
FIG. 2 is a top plan view of the base unit of the electronic musical device of the present invention.
Figure 3:
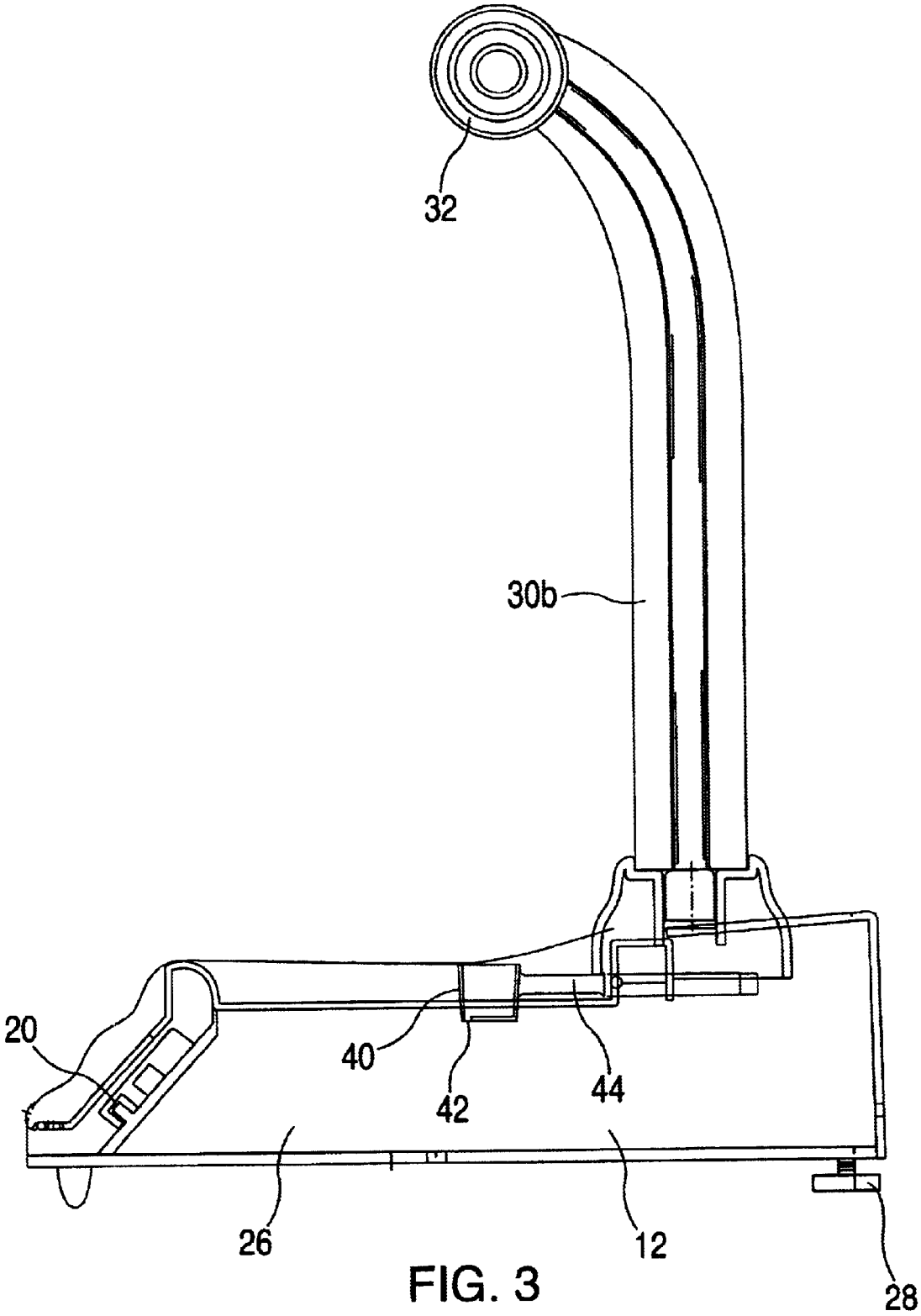
FIG. 3 is a side view of the electronic musical device of the present invention, illustrating the alignment of the drip tube and the keys.

As shown in FIGS. 1 and 2, the base 12 contains all the electronics components, including microprocessors (not shown), speakers 18, controllers 20, liquid pump 22, synthesizer 24, etc. These individual electronic components are common and known to one skilled in the art and are not described in detail. The controllers 20 provide a selection of musical instruments to be synthesized by the musical device 10, volume, etc. The base 12 has a reservoir 26 and the keyboard 16 is positioned over the reservoir 26. The base 12 also has a pair of adjustable feet 28 (as shown in FIG. 3) for leveling the base 12 for proper alignment. Optionally, the base contains an output jack for stereo output and another jack for AC power connection (not shown).

The tube assembly 14 comprises a pair of curved tubes 30*a* and 30*b* and a drip tube 32. The pair of curved tubes 30*a* and 30*b* extend substantially vertically from the base 12. The drip tube 32 horizontally interconnects the top of the curved tubes 30*a* and 30*b* and is rotatably connected to the curved tubes 30*a* and 30*b*. Liquid, preferably water, is pumped up curved tube 30*a*, across drip tube 32 and down curved tube 30*b*.

Figure 4:
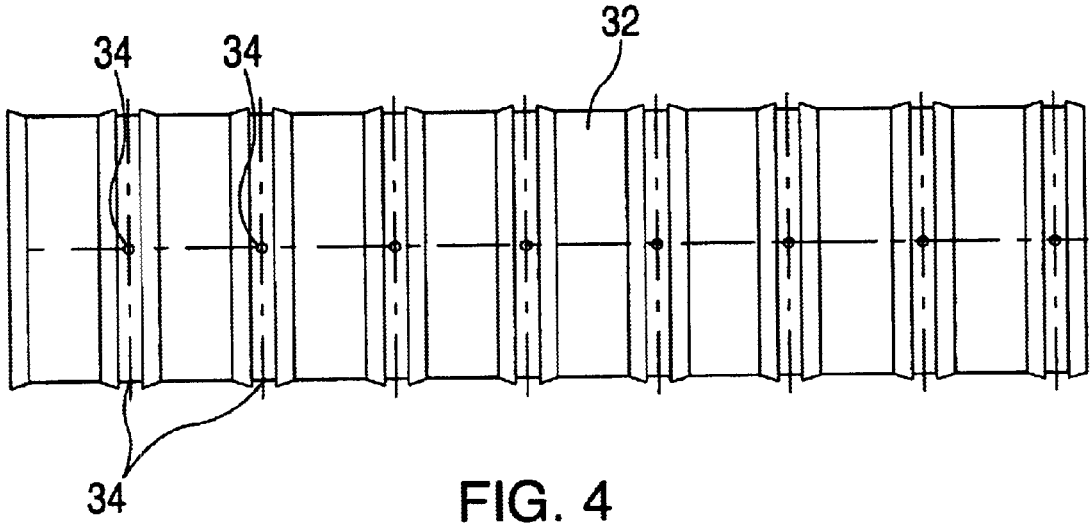
FIG. 4 illustrates the drip tube with small holes.

As shown in FIG. 4, the horizontal drip tube 32 has a plurality of spaced-apart channels 34 along the axial length of the drip tube 32. On the surface of each channel is a small hole 36. A long thin strand of material 38, such as rope, is inserted into and through each small hole 36, with the remaining length of the strand of material 38 wound around each channel 34 (as shown in FIG. 1). The loose end of the strand of material 38 is secured to the channel 34 by glue or tape (not shown). When water is inside the drip tube 32, water adheres to the end of the material 38 inserted into the small hole 36 and water drops formed at and dripped from the small hole 36. Each channel 34 of the drip tube 32 is positioned over and in alignment with a corresponding key 40 of the keyboard 16. Since the diameter of the hole 36 is small, to ensure that water inside the drip tube 32 whets the surface of the drip tube 32 and flows through the small hole 36, the strand of material 38 is selected for its properties of being easily whetted by the water and promotes flowing through the small hole 36 by wicking action. The remaining length of the strand of material 38 around each channel 34 provides an easily whetted, known width, surface to produce an appropriate sized water drop. Further, it ensures that all water drops are about the same size after the material 38 is properly whetted.

The keyboard 16 has a plurality of cup shape keys 40 positioned over the reservoir 26. The cup shape key 40 minimizes any splashing of liquid when liquid is dripped into it from drip tube 32. The bottom of each cup shape key 40 has an opening 42 for releasing liquid dripped into it into the reservoir 26. Each cup shape key 40 has an extended arm 42 pivotably attached to the base 12. The free end of each arm 44 actuates the synthesizer 24 and microprocessor (not shown) to produce a musical tone of a selected musical instrument at the speakers 18 when the key 40 is moved by liquid dripped into it.

When the drip tube 32 is rotated such that the small holes 36 are positioned in the lowest gravitational position, liquid drops formed and dripped at a higher frequency than if the small holes 36 are at an angle. With liquid drops dripping at a higher frequency, a more upbeat musical composition result. Whereas, a slower frequency of liquid drops result in a more relaxing musical composition.

An optional feature of the controllers 20 is a preprogrammed timed sleep mode, which allows one to set the device 10 to stop playing within a predetermined time period. The frequency of the liquid drops will gradually decrease over time by pumping gradually less water into the drip tube 32 until it stops at the predetermined time period. Similarly, the volume of the speaker will gradually decrease over the same time period until it stops.

The microprocessor utilized in the present invention includes a program containing basic rules for musical harmony and chord progressions. While the notes played by the falling drops are random, the notes played or generated are according to the rules of music for pleasing harmonious sounds of the chords and rules of the progression of the chords with time. It is understood that the program can be written to follow general rules for a good ballad or the general rules for "avant garde" music such as those of Schoenberg.

The features of the invention illustrated and described herein is the preferred embodiment. Therefore, it is understood that the appended claims are intended to cover unforeseeable embodiments with insubstantial differences that are within the spirit of the claims.

What I claim is:

1. An electronic musical device actuated by random liquid drops that produces synthesized musical tones, comprises:

a base;

means for synthesizing musical tones;

a keyboard having a plurality of keys attached to said base, each of said keys connected to said synthesizing means to produce a selected musical tone in response to a physical contact;

a tube assembly including at least a tubular member extending above said keys of said keyboard, said tubular member having means for producing drops of liquid above each key when a liquid is positioned in said tube assembly, said drops are adapted to fall periodically onto said keys to actuate said synthesizing means in response to selective contact of each key by said drops to produce a melody.

2. The device of claim 1 further comprises means for selectably propelling the movement of said liquid through said tubular member.

3. The device of claim 2, wherein said tube assembly includes a pair of tubes extending from said base with each having a first end mounted on said base and a second end connected to said tubular member.

4. The device of claim 2 wherein said propelling means comprises a liquid pump.

5. The device of claim 1 wherein said synthesizing means comprises at least one microprocessor, at least one speaker and at least one synthesizer.

6. The device of claim 1 wherein said base has a reservoir containing said liquid and said keys being pivotablly attached to said base.

7. The device of claim 1 further comprises a pair of adjustable feet for leveling said base for proper alignment of said tube assembly and said keyboard.

8. The device of claim 1 further comprising means for regulating the size of said drops and the frequency of formation of said drops to control the speed of the melody produced by said synthesizer means.

9. The device of claim 3 wherein the liquid is adapted to be propelled up one of said pair of tubes from said base, across said tubular member and down said other one of said pair of tubes.

10. The device of claim 3 wherein said tubular member having a plurality of small holes, each hole is positioned over a corresponding key of said keyboard.

11. The device of claim 10 wherein said tubular member is rotabably connected to said second ends of said pair of tubes to vary the positioning of said small holes relative to corresponding keys, whereby the frequency of formation of said drops is controlled.

12. The device of claim 3 wherein said tubular member having a plurality of spaced-apart channels along the axial length of said tubular member, a small hole on the surface of each of said channel corresponding to a key of said keyboard and a strand of material inserted into and through each of said small hole, with the remaining length of the strand of material wound around each channel.

13. The device of claim 1 wherein each of said key is cup shaped.

14. The device of claim 13 wherein each of said cup shape key having a bottom with an opening for releasing liquid dropped into it from said tube assembly.

* * * * *